US007479592B1

(12) United States Patent
Slavik

(10) Patent No.: US 7,479,592 B1
(45) Date of Patent: Jan. 20, 2009

(54) STRINGED INSTRUMENT VIBRATO DEVICE

(76) Inventor: Randal L Slavik, 3570 Douglass, Memphis, TN (US) 38111

( * ) Notice: Subject to any disclaimer, the term of this patent is extended or adjusted under 35 U.S.C. 154(b) by 0 days.

(21) Appl. No.: 11/749,719

(22) Filed: May 16, 2007

Related U.S. Application Data

(60) Provisional application No. 60/801,357, filed on May 18, 2006.

(51) Int. Cl.
*G10D 3/00* (2006.01)

(52) U.S. Cl. ..... 84/313; 84/312 R

(58) Field of Classification Search ..... 84/313, 84/312 R, 312 P
See application file for complete search history.

(56) References Cited

U.S. PATENT DOCUMENTS

| | | | | | |
|---|---|---|---|---|---|
| 3,404,595 | A | * | 10/1968 | Harlin | 84/312 P |
| 4,712,463 | A | | 12/1987 | Kubicki et al. | |
| 4,939,971 | A | * | 7/1990 | Satoh | 84/313 |
| 5,083,492 | A | * | 1/1992 | Gorr | 84/313 |
| 5,373,769 | A | * | 12/1994 | Sherman | 84/313 |
| 5,672,835 | A | * | 9/1997 | Doughty | 84/313 |
| 5,986,190 | A | | 11/1999 | Wolff et al. | |
| 6,384,311 | B1 | | 5/2002 | Cota | |
| 6,415,584 | B1 | * | 7/2002 | Whittall et al. | 84/312 R |
| 6,812,389 | B2 | | 11/2004 | Trooien | |
| 6,919,501 | B2 | | 7/2005 | Burton | |
| 2003/0183062 | A1 | | 10/2003 | Schryer | |
| 2004/0051925 | A1 | | 3/2004 | Smart | |
| 2004/0083875 | A1 | | 5/2004 | Burton | |
| 2005/0076766 | A1 | | 4/2005 | Didan | |
| 2006/0005687 | A1 | | 1/2006 | Minakuchi | |
| 2006/0117930 | A1 | | 6/2006 | Folmar et al. | |

* cited by examiner

*Primary Examiner*—Walter Benson
*Assistant Examiner*—Jianchun Qin
(74) *Attorney, Agent, or Firm*—Quick Patents, Inc; Kevin Prince

(57) ABSTRACT

A vibrato device for an instrument, such as a guitar, comprises a base plate having a forward side with a pivot means and at least one elongated bridge post fixed thereto. Each bridge post is fixed to at least one of the strings of the instrument above a top surface of the base plate and includes a spring fixed below a bottom surface thereof. The spring generally balances the string tension around the pivot means. A vibrato handle is fixed to the base plate, and when moved it causes the base plate to pivot around the pivot means and the effective pitch of each string is changed accordingly. Yet each string may be tuned against the string biasing means independently of any other string since each string has its own spring biasing means.

12 Claims, 3 Drawing Sheets

STRINGED INSTRUMENT VIBRATO DEVICE

CROSS-REFERENCE TO RELATED APPLICATIONS

This application claims the benefit of U.S. Provisional Patent Application 60/801,357, filed on May 18, 2006, and is hereby incorporated herein.

STATEMENT REGARDING FEDERALLY SPONSORED RESEARCH AND DEVELOPMENT

Not Applicable.

FIELD OF THE INVENTION

This invention relates to musical instruments, and more particularly to a novel vibrato device for a stringed instrument.

DISCUSSION OF RELATED ART

Vibrato devices for guitars and other stringed instruments have been in use for many years for the special effect of bending the pitch of a note either higher or lower. Herein the term guitar typically refers to six-stringed guitars, but could mean any stringed instrument with any number of strings. The typical design used on guitars comprises a pivoting base plate located at the rear of the instrument, one or more string attachment devices mounted on top of the plate and an attached lever that, when moved, produces the vibrato effect. Typically, two or three springs are attached at one end to the bottom of the plate to offset the tension of the strings, the strings being anchored to the instrument at their other ends.

Two basic types of vibratos exist: single directional, which can only change the pitch in one direction—usually higher, and two directional, which can either raise or lower the pitch at the musician's discretion.

The single directional vibrato is historically much older. It is fairly simple in design due to its limited abilities, relatively easy to tune and operate and is of no concern here.

The two directional device, often referred to as "full floating" vibrato, is more versatile to the musician and far more complex in design. Although these units are very popular, mostly among rock guitarists, every device on the market today has the same flaw—the inability to let the user tune the instrument quickly.

A non-vibrato, or solid-bridge guitar, such as the standard acoustic can be tuned by the average user in 1-2 minutes from a completely out of tune but "strings still attached" position. String replacement on a solid bridge guitar can easily be done by removing all six strings simultaneously, reattaching the six new strings and tuning them one at a time, usually in order from the lowest pitch string to the highest. Tuning each string only once results in the guitar being properly tuned when the series is finished. A single directional vibrato guitar may be tuned in substantially the same amount of time.

A full floating vibrato unit, however, will take the average user hours if not days to tune from a completely detuned condition, and many users find it beyond their ability entirely. The procedure involves far more than string pitch, becoming a delicate balancing act between the strings, the base plate, and springs located inside the body of the guitar. The procedure is so tedious that it is common to take the guitar to an experienced technician for a "set-up" requiring both time and money whenever new strings are required.

String replacement instructions included with the purchase of a new full floating guitar instruct the user to remove one string at a time, re-attach a new string, and re-tune the entire guitar before removing the next string. The process is then repeated five more times, once for each additional string. Even though this is far more tedious tuning than a solid bridge or single direction vibrato, the average user is capable of tuning his own guitar if that was the entire process.

However, the very nature of a full floating device forces the user to also level the "floating" base plate as well as tune the strings. Each time a string it tightened, the rear of the pivoting base plate rises. Each time the rear of the base plate rises, the tension of all other attached strings is lessened, dropping each in pitch. Tightening one string raises the rear of the base plate and in turn loosens all other strings. So in essence, raising the pitch of one string lowers the pitch of all other strings. Further, the tightening or loosening of the strings by use of the device stretches strings over time, loosening and detuning them. Common equipment on full floating guitars include tuning knobs and string locks at both ends of the guitar to help with the stretching problem, but the process is still too cumbersome for many guitarists.

The public has found the problem so annoying that numerous devices are presently available on the market to try to help the average user tune a guitar without a technician's help. Several examples of such devices are taught in US patent applications and patents 2004/0051925 to Smart on Mar. 18, 2004; 2004/0083875 to Burton on May 6, 2004; U.S. Pat. No. 6,812,389 to Trooien on Nov. 2, 2004; U.S. Pat. No. 6,919,501 to Burton on Jul. 19, 2005; and 2006/0005687 to Minakuchi on Jan. 12, 2006. Some of these devices lock the base plate from "floating" until the strings are tuned and the lock is removed, at which time the base plate moves anyway. Others lock the base plate permanently, deactivating the vibrato. While the guitar is then tunable, it behaves as nothing more than a solid bridge guitar, unsuitable for the serious enthusiast who wishes to have a vibrato effect as a playing option. Indeed, many guitarists have the device removed completely, opting for a solid bridge, to avoid the tuning problem altogether.

Further, if a string breaks while playing a full floating guitar, the guitarist is immediately thrown out of tune relative to other band members. Since the strings and springs are thrown out of balance with one less string pulling the plate upward, the springs take up the slack by pulling the plate downward, raising the pitch of the other five strings. Such an incident during a live performance can be disastrous if a replacement string and/or guitar is unavailable. US Patent Application 2005/0076766 to Didan on Apr. 14, 2005, attempts to address this problem.

U.S. Pat. No. 6,384,311 to Cota on May 7, 2002, shows a bass guitar with four separate vibrato units, one for each string. However, there is no way to vibrato all four strings together short of pushing on all four arms simultaneously.

US Patent Application 2003/0183062 to Schryer on Oct. 2, 2003, uses wheels that are notched like teeth on a sprocket, and each sprocketed wheel is locked inside a large cylindrical encasement. As such, there is no freedom of movement between strings once locked in place.

Therefore, there is a need for a vibrato device that allows for independent tuning of each string without substantially affecting the tuning of other strings. Such a needed device would allow for quickly tuning all strings on the instrument, while still providing for an effective two-directional vibrato effect. Further, such a needed device would be easily added to existing guitars and other stringed instruments. The present invention accomplishes these objectives.

SUMMARY OF THE INVENTION

The present device is a vibrato device for an instrument, such as a guitar, that has at least one string. The device comprises a base plate that has a top surface, a bottom surface, and at least one peripheral edge that connects the top and bottom surfaces. The at least one peripheral edge includes at least a forward side that has a pivot means fixed proximate thereto that includes a plurality of tapered notches and a plurality of pivot bolts. Each bolt is fixed at one end to the instrument and has at a second end a tapered waist for engaging one of the tapered notches. As such, with tension of the at least one string forcing the base plate into the pivot bolts, the base plate may pivot around the forward side thereof but is restrained from lateral or elevational movement relative to the pivot bolts.

At least one elongated bridge post is fixed to the base plate, each bridge post being fixed to at least one of the strings of the instrument above the top surface of the base plate. Each bridge post includes a coil spring that keeps the string in tension at the bridge post. The coil spring is fixed below the bottom surface of the base plate, and generally balances the string tension around the pivot means.

Each coil spring includes a second end that is preferably fixed to a spring attachment plate by spring bolts. The spring attachment plate is fixed to the instrument with at least one instrument mounting bolt that traverses a bolt aperture formed in a forward end of the spring attachment plate.

A vibrato handle is fixed to the base plate 40 preferably at a threaded end by a nut. When the vibrato handle is moved, it causes the base plate to pivot around the pivot means and the effective pitch of each string is changed accordingly. Yet each string may be tuned against the string biasing means independently of any other string since each string has its own spring biasing means, and since when tuning one string the effective tension on the base plate changes only in relation to the force of the base plate into the pivot means, the string biasing means counterbalancing any change in tension in the string by tuning. As such, the tension and therefore the effective pitch of each other string is held relatively unchanged.

The device may further include a roller support that is mounted to the base plate with roller support mounting screws that engage roller support mounting bolt apertures formed in the base plate. The roller support rotationally supports at least one string roller, each roller engaging one of the instrument strings at a substantially fixed point therealong with regard to the base plate.

The present invention is a vibrato device that allows for independent tuning of each string without substantially affecting the tuning of other strings. The present device allows for quickly tuning all strings on the instrument, while still providing for an effective two-directional vibrato effect. Further, the present invention is easily added to existing guitars and other stringed instruments. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
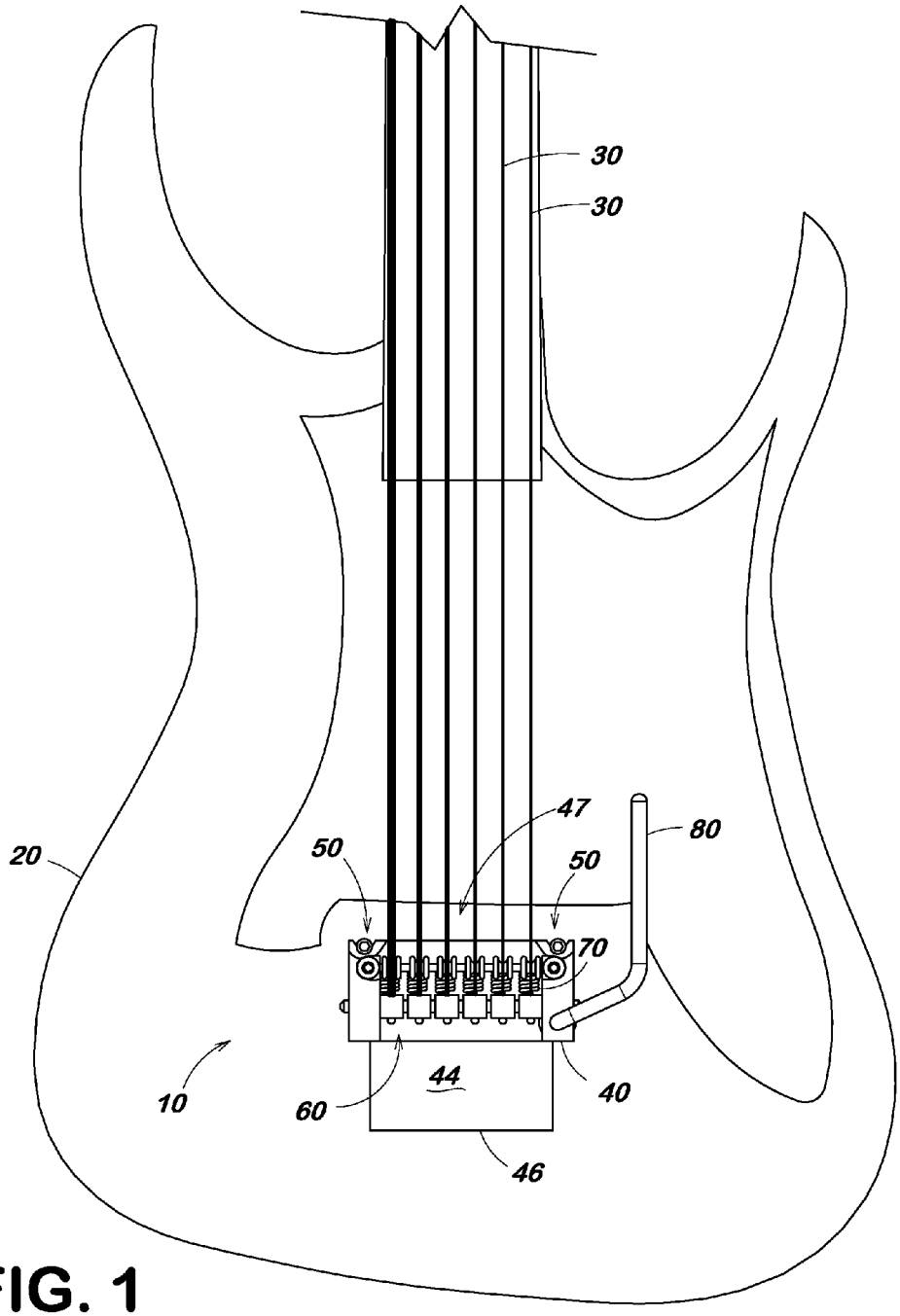
FIG. 1 is a partial top plan view of the invention as installed in a guitar.

FIG. 1 illustrates a vibrato device 10 for an instrument 20, such as a guitar, that has at least one string 30. The instrument 20 includes tuning knobs at a distal end of each string for increasing the tension within the string and thereby changing the pitch of each string when strummed (not shown).

The device 10 comprises a base plate 40 that has a top surface 44, a bottom surface 46, and at least one peripheral edge 45 that connects the top and bottom surfaces 44,46. The at least one peripheral edge 45, preferably four in the case of a rectangular base plate (not shown), or six as illustrated best in FIG. 1, includes at least a forward side 47 that has a pivot means 50 fixed proximate thereto. The base plate is made from a rigid material, such as a metal or metal alloy plate material. Alternately, a rigid, strong, and durable plastic material may be used.

Figure 2:
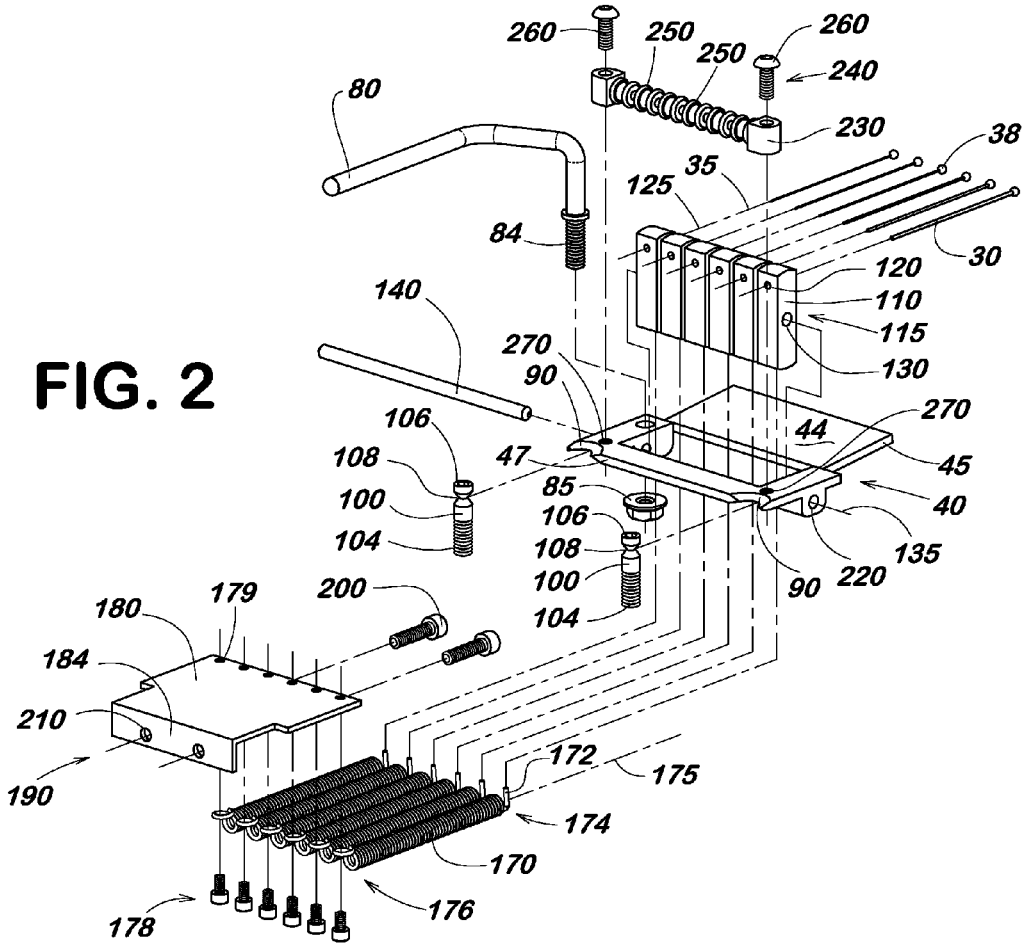
FIG. 2 is an exploded view of the invention.
Figure 4:
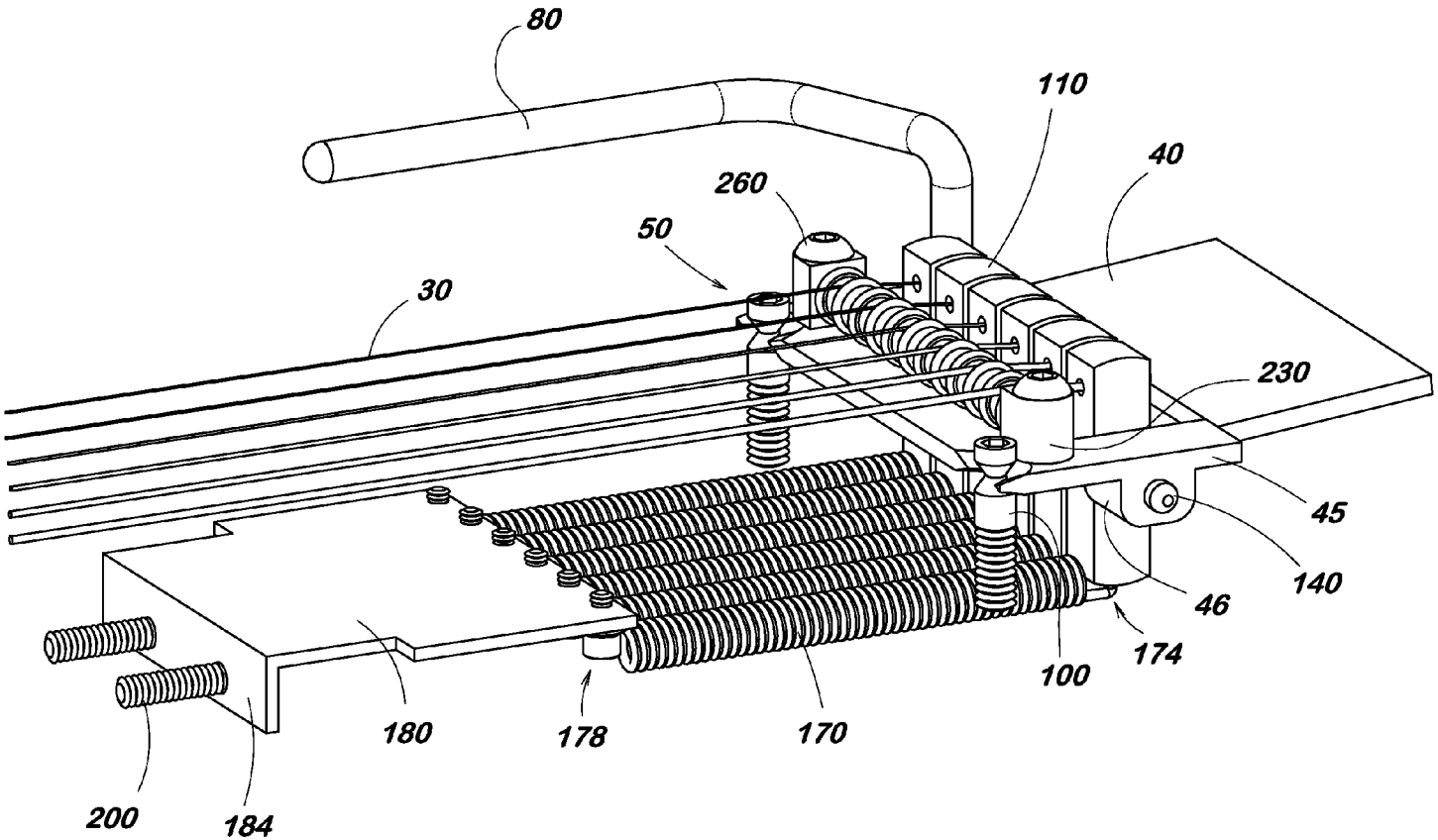
FIG. 4 is a perspective view of the invention.

The pivot means 50 preferably includes a plurality of tapered notches 90 in the forward side 47 of the peripheral edge 45 of the base plate 40, and a plurality of pivot bolts 100 (FIGS. 2 and 4). Each bolt 100 is fixed at one end 104 to the instrument 20 and has at a second end 106 a tapered waist 108 for engaging one of the tapered notches 90, as illustrated in FIG. 4. As such, with tension of the at least one string 30 forcing the base plate 40 into the pivot bolts 100, the base plate 40 may pivot around the forward side 47 thereof but is restrained from lateral or elevational movement relative to the pivot bolts 100.

Other pivot means 50 may be used, however, as is known in the art, without changing the spirit and scope of the present invention. For example, a hinge with a pivoting axle (not shown) or other means may be used.

At least one string attachment means 60 is fixed to the base plate 40, each string attachment means 60 being fixed to at least one of the strings 30 of the instrument 20 above the top surface 44 of the base plate 40. Each string attachment means 60 includes a string biasing means 70, such as a coil spring 170 or a piece of flat spring steel (not shown), that keeps the string 30 in tension at the string attachment means 60. The string biasing means 70 is fixed below the bottom surface 46 of the base plate 40, and generally balances the string tension around the pivot means 50 (FIG. 4).

Figure 3:
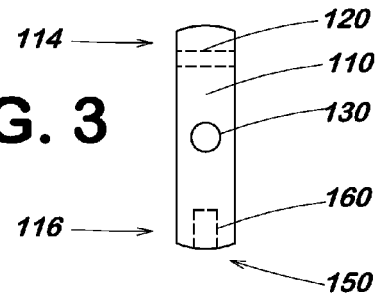
FIG. 3 is a side elevational view of a bridge post of the invention.

Preferably each string attachment means 60 includes an elongated bridge post 110 (FIG. 3) having at a top end 114 an aperture 120 therein for receiving at least one of the strings 30 of the instrument 20. The longitudinal axis 125 of the aperture 120 is preferably co-aligned with the longitudinal axis 35 of the string (FIG. 2). Typically the string 30 includes a ball 38 at one end thereof, the aperture 120 being smaller than the ball 38 so that the string 30 is captured thereby. Further, each bridge post 110 includes proximate a center region 115 thereof a pivot aperture 130 therein for pivoting around a pivot pin 140 that is fixed to the base plate 40 (FIGS. 2 and 3). The pivot pin 140 is fixed to the base plate 40 through a pair of pivot pin apertures 220 the base plate 40 (FIG. 2), and the longitudinal axis 135 of the pivot aperture 130 is substantially perpendicular to the longitudinal axis 125 of the aperture 120. Each bridge post 110 preferably further includes a spring attachment means 150, such as a spring attachment aperture 160, fixed proximate a bottom end 116 thereof for attaching to the string biasing means 70. The spring attachment aperture 160 traverses the bottom end 116 of each bridge post 110 and is coaxially aligned therewith (FIG. 3).

Other string attachment means 60 may be used, however. For example, instead of elongated bridge posts 110, rotating disks may be used (not shown), or pivoted levers (not shown). The important aspect of the present invention is that, regardless of the form taken by the string attachment means 60, the string biasing means 70 counters the tension in each string 30 around the pivot means, so that increasing the tension in the strings 30 simply increases the force holding the base plate 40 into the pivot means 50. As such, each string 30 has one corresponding string biasing means 70 and, when tuned, does not affect the tension on the other strings 30. Further, fine tuners and locks (not shown) such as those produced by Floyd Rose may be incorporated into the string attachment means 60 to provide fine tuning capability of each string 30 at the device 10.

Each coil spring 170 has one end 174 formed into a post 172 that is substantially perpendicular to the longitudinal axis 175 of the coil spring 170, the post 172 being fixed to one of the spring attachment means 150 such as by being coaxially inserted into the spring attachment aperture 160 and held frictionally thereby. Each coil spring 170 includes a second end 176 that is preferably fixed to a spring attachment plate 180 by spring bolts 178 (FIGS. 2 and 4) engaging apertures 179 in the spring attachment plate 180. The spring attachment plate 180 is fixed to the instrument 20 with a spring attachment plate mounting means 190, such as at least one instrument mounting bolt 200 that traverses a bolt aperture 210 formed in a forward end 184 of the spring attachment plate 180 (FIGS. 2 and 4). The means of holding a device such as the present invention to the instrument 20 is known in the art, and therefore any known method may be used.

A vibrato handle 80, preferably made of rigid metal bar stock, is fixed to the base plate 40 preferably at a threaded end 84 by a nut 85 (FIG. 2). When the vibrato handle 80 is moved, it causes the base plate 40 to pivot around the pivot means 50 and the effective pitch of each string 30 is changed accordingly. Yet each string may be tuned against the string biasing means independently of any other string 30 since each string 30 has its own spring biasing means 70, and since when tuning one string 30 the effective tension on the base plate 40 changes only in relation to the force of the base plate 40 into the pivot means 50, the string biasing means 70 counterbalancing any change in tension in the string 30 by tuning. As such, the tension and therefore the effective pitch of each other string 30 is held relatively unchanged.

The device 10 may further include a roller support 230 that is mounted to the base plate 40 with a roller support mounting means 240, such as roller support mounting screws 260 that engage roller support mounting bolt apertures 270 formed in the base plate 40. The roller support 230 rotationally supports at least one string roller 250, each roller 250 engaging one of the instrument strings 30 at a substantially fixed point therealong with regard to the base plate 40 (FIG. 4). That is to say, as the base plate 40 is pivoted, each roller may roll only slightly under the string 30, the effective length of each string 30 being held relatively constant while the tension in each string 30 is varied by the movement of the base plate 40.

While a particular form of the invention has been illustrated and described, it will be apparent that various modifications can be made without departing from the spirit and scope of the invention. For example, various shapes of bridge posts 110 may be used, as wells as various shapes of base plates 40. Accordingly, it is not intended that the invention be limited, except as by the appended claims.

What is claimed is:

1. A vibrato device for an instrument having a plurality of strings, the device comprising:

a base plate having a top surface, a bottom surface, and at least one peripheral edge connecting the top and bottom surfaces, the at least one peripheral edge comprising a forward side having a pivot means fixed proximately thereto;

a plurality of string attachment means fixed to the base plate and pivotable relative to the base plate about an axis substantially distally parallel to the forward side of the peripheral edge, each string attachment means fixed to one string of the instrument and including a string biasing means that keeps the string in tension at the string attachment means, the string biasing means generally balancing the string tension around the pivot means;

a vibrato handle fixed to the base plate, the handle when moved causing the base plate to pivot around the pivot means;

whereby with each string of the instrument being fixed to one of the string attachment means, each string tunable against the string biasing means independently of any other string, the base plate being biased thereby towards the pivot means along the longitudinal axis of the strings, and whereby the vibrato handle may be moved to cause the base plate to pivot around the pivot means to cause the effective pitch of each string to be changed thereby.

2. The vibrato device of claim 1 wherein the pivot means includes two tapered notches in the forward side of the peripheral edge and two pivot bolts, each bolt fixed at one end to the instrument and having at a second end a tapered waist for engaging one of the tapered notches, whereby with tension from each string and string biasing means biasing the base plate towards the pivot bolts, the base plate may pivot on the bolts at the notches therein while being prevented from lateral or elevational movement thereon.

3. The vibrato device of claim 1 wherein each string attachment means is an elongated bridge post having at a top end an aperture therein for receiving at least one of the strings of the instrument, the longitudinal axis of the aperture co-aligned with the longitudinal axis of the string, the bridge post further including proximate a center region a pivot aperture therein for pivoting around a pivot pin fixed to the base plate, the longitudinal axis of the pivot aperture being substantially perpendicular to the longitudinal axis of the string aperture, the bridge post further including a spring attachment means fixed at a bottom end thereof for attaching to the string biasing means.

4. The vibrato device of claim 3 wherein each spring attachment means is a spring attachment aperture traversing the bottom end of one of the bridge posts and coaxially aligned therewith.

5. The vibrato device of claim 4 wherein the one end of each coil spring terminates in a post that is substantially perpendicular to the longitudinal axis of the coil spring and that may be inserted coaxially into the spring attachment aperture of each bridge post and held frictionally thereby.

6. The vibrato device of claim 4 wherein each coil spring includes a second end fixed to a spring attachment plate, the spring attachment plate being fixed to the instrument with a spring attachment plate mounting means.

7. The vibrato device of claim 6 wherein the spring attachment plate mounting means is at least one instrument mounting bolt, each attachable to the instrument through a bolt aperture formed in a forward end of the spring attachment plate.

8. The vibrato device of claim 3 wherein the one end of each coil spring is fixed to the spring attachment means of each bridge post.

9. The vibrato device of claim 3 wherein the pivot pin is fixed to the base plate through a pair of pivot pin apertures in the base plate.

10. The vibrato device of claim 1 wherein each string biasing means is a coil spring having one end fixed to one of the spring attachment means.

11. The vibrato device of claim 1 further including a roller support mounted to the base plate with a roller support mounting means, the roller support rotationally supporting at least one string roller, each roller for engaging one of the instrument strings at a substantially fixed point therealong with regard to the base plate.

12. The vibrato device of claim 11 wherein the roller support means is a pair of roller support mounting screws engageable with roller support mounting bolt apertures formed in the base plate.

* * * * *